US008036577B2

(12) United States Patent
Tokutake et al.

(10) Patent No.: US 8,036,577 B2
(45) Date of Patent: Oct. 11, 2011

(54) IMAGE FORMING METHOD AND IMAGE FORMING APPARATUS

(75) Inventors: Shigeaki Tokutake, Tokyo (JP); Shinichi Yabuki, Kanagawa (JP); Chigusa Yamane, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 382 days.

(21) Appl. No.: 12/248,966

(22) Filed: Oct. 10, 2008

(65) Prior Publication Data

US 2009/0103953 A1 Apr. 23, 2009

(30) Foreign Application Priority Data

Oct. 18, 2007 (JP) ..... 2007-270992

(51) Int. Cl.
*G03G 15/08* (2006.01)

(52) U.S. Cl. ..... 399/259

(58) Field of Classification Search ..... 399/259
See application file for complete search history.

(56) References Cited

U.S. PATENT DOCUMENTS 6,300,024 B1 * 10/2001 Yusa et al. ..... 430/45.5

FOREIGN PATENT DOCUMENTS

JP 57099654 A * 6/1982
JP 01302268 A * 12/1989

* cited by examiner

*Primary Examiner* — David Gray
*Assistant Examiner* — Erika J Villaluna
(74) *Attorney, Agent, or Firm* — Lucas & Mercanti, LLP

(57) ABSTRACT

An objective is to provide an image forming method and an image forming apparatus exhibiting neither failure in lack of line image nor image defect in halftone images, together with extremely high image quality and longer lifetime. Disclosed is an image forming method possessing the steps of evenly charging an organic photoreceptor; conducting a light exposure process; conducting a developing process to visualize the electrostatic latent image formed on the organic photoreceptor to form a toner image; transferring the toner image into a transfer medium; and conducting a cleaning process to remove a residual toner from the organic photoreceptor, the method further comprising the step of replenishing a developing device with a developer comprising toner and carrier, wherein the organic photoreceptor comprises a surface protective layer containing a filler, and the carrier is mixed with the toner, after attaching a lubricant onto a carrier particle in advance.

14 Claims, 4 Drawing Sheets

IMAGE FORMING METHOD AND IMAGE FORMING APPARATUS

This application claims priority from Japanese Patent Application No. 2007-270992 filed on Oct. 18, 2007, which is incorporated hereinto by reference.

TECHNICAL FIELD

The present invention relates to an image forming method and an image forming apparatus to develop an electrostatic latent image.

BACKGROUND

A two-component developing method has been used widely as an excellent developing method in an electrophotographic developing method, but it still has some problems even today. Among the problems, there is a strong demand for a two-component developer which can be used for a long time and their properties are constant and stabilized for their total service period.

Also proposed has been a photoreceptor possessing a surface protective layer in which particles are dispersed for longer lifetime of the photoreceptor as a promising approach to obtain high image quality and longer lifetime in the entire conventional image forming processes. Further, concerning measures of high image quality and failure in lack of line image, the following proposals are given since contributions from the photoreceptor surface are high.

(1) A lubricant is coated on the photoreceptor surface in order to enrich lubrication of a photoreceptor.

(2) A lubrication providing material is added into a photoreceptor surface protective layer solution to conduct coating.

(3) A lubricant released from toner is brought into the photoreceptor surface in which particles are dispersed.

However, regarding (1), it reflects unfavorably upon measures of downsizing of apparatuses as well as energy saving.

Regarding (2), it is difficult to distribute a material exhibiting a lubrication effect evenly on a surface protective layer with a conventional immersion coating method, and the outermost surface portion of the surface protective layer becomes low in concentration. Therefore, the photoreceptor surface needs to be mechanically polished by the aftertreatment process or the like to expose the material exhibiting a lubrication effect on the photoreceptor surface, whereby high cost can not be avoided (refer to Patent Document 1, for example).

For this reason, it is proposed that particles made of a lubrication providing material (fluorine resin particles, for example) are dispersed on the photoreceptor surface by a CSH coating method (a slide hopper coating method) to disperse particles evenly on the outermost surface of the photoreceptor, but scratches are easily generated, whereby failure in streak-shaped noise is generated, though extension effects from the lubrication providing material are highly produced.

Regarding (3), there appear problems such as lowering of electrification, generation of powder smoke and so forth when an addition amount of a lubricant into toner is too much since the addition amount is limited, though a certain level of a releasing property is effective. Further, a supplying amount of a lubricant into the photoreceptor surface is changed when a print ratio during image formation is varied, whereby the releasing property of the photoreceptor surface is varied, resulting in unfavorably influenced image quality.

On the other hand, in recent years, studies on small sized toner particles have been actively done for the purpose of obtaining high image quality. In this case, there were problems such as lowered toner fluidity, lack of stability in frictional electrification with carrier and so forth. In order to solve these problems, the amount of external additives added for obtaining the toner fluidity tends to be increased. However, in the case of a large amount of external additives, the amount transferring into carrier during storage as well as developing treatment is also increased, whereby stable images tend to be difficult to be obtained for a long duration since charge providing performance of carrier is lowered for the foregoing reason, and there appears a large difference of developer properties between at the initial stage of developer preparation and after aging of the developer.

Consequently, proposed is a developing system (so-called trickle developing system) in which when toner is newly supplied in response to toner consumed via development, carrier is added, and carrier in a developing device is interchanged little by little by gradually removing a usually excessive amount of developer to stabilize developer concentration via suppression of change in electrification (refer to Patent Document 2, for example).

In the foregoing trickle development, the fluctuation of the amount of charge has been tried to be suppressed by gradually replacing the carrier with a fresh carrier. However, in combination with the toner having a small diameter, a phenomenon in such a way that the amount of charge sometimes becomes smaller is often generated. This reason might be considered as follow; in the case of the toner having a small diameter wherein the surface area per a unit volume is large, the amount of external additives to be added is large, and thereby, the amount of the external additives transferred to the newly supplied carrier is also large, resulting in decrease of a charge providing property of carrier.

Specifically, when printing of many sheets consuming a large amount of toner is carried out, the amounts of toner and carrier to be supplied become greater, and the charge providing property caused by transfer of external additives to the newly supplied carrier is easy to be generated, whereby undesired image fog or unevenness in image density were often generated.

(Patent Document 1) Japanese Patent O.P.I. Publication No. 5265243

(Patent Document 2) Japanese Patent Examined Publication No. 2-21591

SUMMARY

It is an object of the present invention is to provide an image forming method and an image forming apparatus exhibiting neither failure in lack of line image nor image defect in halftone images, together with extremely high image quality and longer lifetime.

The present invention relates to a releasing property of the photoreceptor surface as one of control factors to obtain high image quality by utilizing small sized toner particles, and it is found out that a lubricant on the photoreceptor surface composed of a surface protective layer containing particles is supplied from a lubricant attached on the carrier surface to achieve the property effectively, and to achieve longer lifetime in the processes.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

Figure 1:
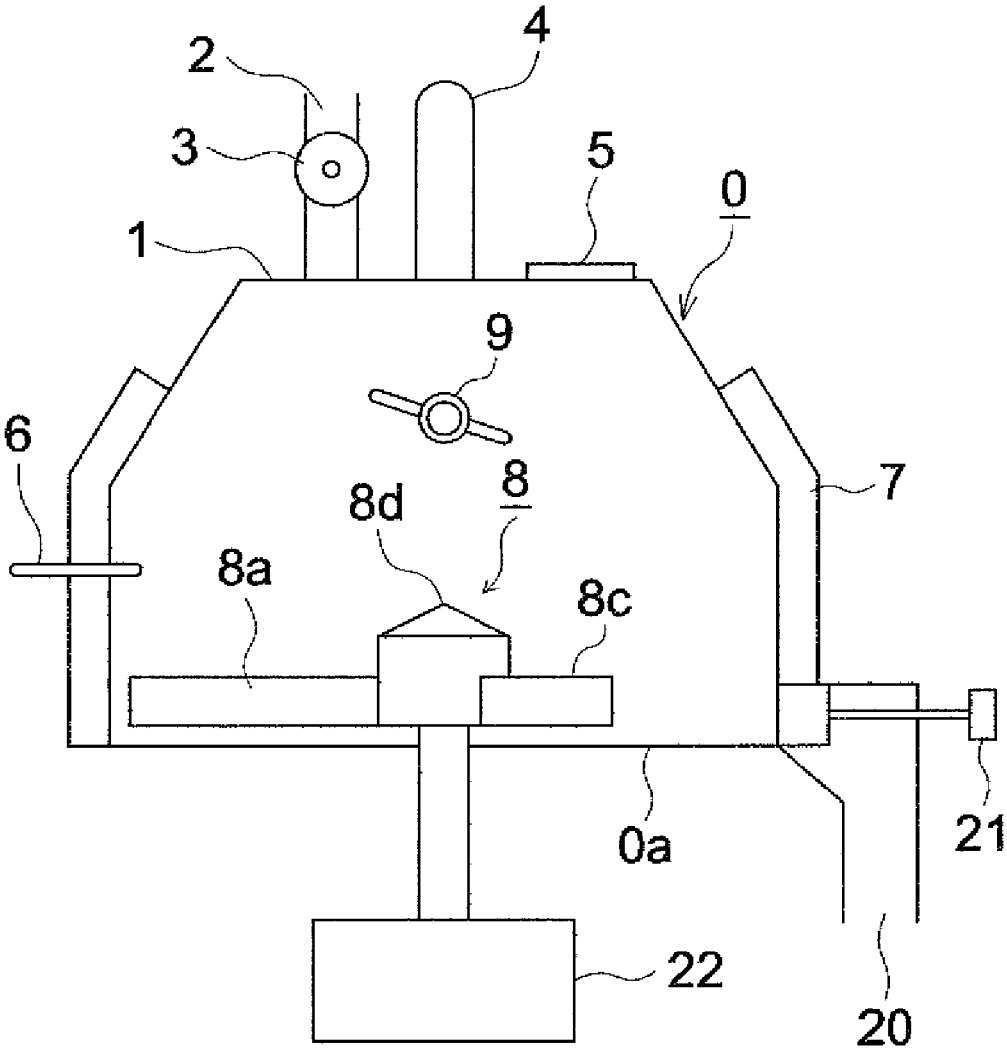
FIG. 1 shows a side view of a high-speed stirring mixer equipped with stirring blades as an example of an apparatus to form a resin coating layer on a magnetic core material via drying.

DESCRIPTION OF THE PREFERRED EMBODIMENTS (Structure 1) An image forming method comprising the steps of evenly charging an organic photoreceptor; conducting a light exposure process to form an electrostatic latent image on the charged organic photoreceptor; conducting a developing process to visualize the electrostatic latent image formed on the organic photoreceptor to form a toner image; transferring the toner image onto a transfer medium; and conducting a cleaning process to remove a residual toner remaining on the organic photoreceptor from the organic photoreceptor, the image forming method further comprising the step of replenishing a developing device with a developer comprising a toner and a carrier, wherein the organic photoreceptor comprises a surface protective layer containing a filler, and the carrier is mixed with the toner, after attaching a lubricant onto a carrier particle in advance.

(Structure 2) The image forming method of Structure 1, wherein the lubricant is present on a surface of the carrier.

(Structure 3) The image forming method of Structure 1 or 2, wherein the lubricant is a compound selected from the group consisting of a fatty acid metal salt, a fluorine-containing resin, a polyolefin resin and a paraffin wax.

(Structure 4) The image forming method of any one of Structures 1-3, wherein the lubricant comprises a stearic acid metal salt.

(Structure 5) The image forming method of any one of Structures 1-4, wherein the lubricant comprises zinc stearate.

(Structure 6) The image forming method of any one of Structures 1-5, wherein the carrier particle has a volume average particle diameter of 20-40 μm.

(Structure 7) The image forming method of any one of Structures 1-6, wherein the filler comprises an inorganic oxide particle.

(Structure 8) The image forming method of any one of Structures 1-7, wherein the filler comprises at least one of a silica particle and an alumina particle.

(Structure 9) An image forming apparatus comprising a charging device to evenly charge an organic photoreceptor; a light exposure device to form an electrostatic latent image on the charged organic photoreceptor; a developing device to visualize the electrostatic latent image formed on the organic photoreceptor to form a toner image; a transfer device to transfer the toner image onto a transfer medium; and a cleaning device to remove a residual toner remaining on the organic photoreceptor from the organic photoreceptor, the image forming apparatus further comprising a replenishing device to replenish a developing device with a developer comprising a toner and a carrier, wherein the organic photoreceptor comprises a surface protective layer containing a filler, and the carrier is mixed with the toner, after attaching a lubricant onto a carrier particle in advance.

(Structure 10) The image forming apparatus of Structure 9, wherein the lubricant is present on a surface of the carrier.

(Structure 11) The image forming apparatus of Structure 9 or 10 wherein the lubricant is a compound selected from the group consisting of a fatty acid metal salt, a fluorine-containing resin, a polyolefin resin and a paraffin wax.

(Structure 12) The image forming apparatus of any one of Structures 9-11, wherein the lubricant comprises a stearic acid metal salt.

(Structure 13) The image forming apparatus of any one of Structures 9-12, wherein the lubricant comprises zinc stearate.

(Structure 14) The image forming apparatus of any one of Structures 9-13, wherein the carrier particle has a volume average particle diameter of 20-40 μm.

(Structure 15) The image forming apparatus of any one of Structures 9-14, wherein the filler comprises an inorganic oxide particle.

(Structure 16) The image forming apparatus of any one of Structures 9-15, wherein the filler comprises at least one of a silica particle and an alumina particle.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The reason why structures of the present invention provide excellent performance is considered as described below.

When a lubricant is attached to inorganic particles present on a toner particle or in the toner particle surface, the lubricant coated on a photoreceptor produces unevenness in quantity caused by an amount of a developing toner based on a latent image and a developing toner pattern, as described before. However, when a lubricant is arranged in such a way that carrier having a lubricant on the carrier surface is replenished with toner, possibly, the lubricant is evenly transferred onto the photoreceptor surface effectively, depending on no latent pattern since the carrier has always been rubbed with the photoreceptor surface. This is considered to obtain a preferable effect produced by influencing strong force of action to lubricant coating during being in contact with a photoreceptor since the carrier has a heavier weight than that of inorganic particles present on the toner particle or in toner particle surface.

In order exist a lubricant contained in a developer evenly on the photoreceptor surface effectively, the lubricant can be evenly supplied into the photoreceptor surface more effectively in this way than by other methods, after the lubricant is attached onto carrier particles to be mixed with toner. Further, when carrier particles having the previously attached lubricant in a developing device are replenished to attach onto inorganic particles existing on the toner particle or in the toner particle surface, and subsequently to further move into the photoreceptor surface via transfer, the supply becomes continuous, and extremely constant.

The structure and utilized compounds in the present invention, and an image forming method and an image forming apparatus thereof are further described.

[Developer of the Present Invention]

A two-component developer employed in the present invention will be described.

The two-component developer of the present invention can be prepared by mixing carrier and toner both relating to the present invention.

As to a mixing ratio for carrier and toner, the toner content is preferably 1-15% by weight. As to a developer for replenishment used during trickle-development, the toner content is preferably 65-95% by weight.

Usable examples of mixing devices to mix carrier and toner include commonly known devices such as a Henschel mixer, a Nauter mixer, a V-type mixer, a tabular mixer and so forth, but of these, a Henschel mixer is preferable.

As a developer of the present invention, utilized is a two-component developer composed of the toner particle having a volume-based median particle diameter of 2.0-12.0 μm and the carrier particle having a volume average particle diameter of 10-60 μm. A lubricant is moved evenly to a photoreceptor with carrier as the effect of the present invention to achieve high image quality by utilizing the toner particle having a volume-based median particle diameter of 2.0-12.0 μm and the carrier particle having a volume average particle diameter of 10-60 μm. A two-component developer composed of the toner particle having a volume-based median particle diameter of 3.0-8.0 μm and the carrier particle having a volume average particle diameter of 20-40 μm is more preferable.

(Carrier of the Present Invention)

Carrier usable in the present invention is not limited, but the resin coating carrier is preferable.

As a binder resin used for forming a resin coating layer, any binder resin can be employed with no limitation, provided that the binder resin is capable of forming a coating layer. However, when forming a resin coating layer with a dry process described below, particles made of a thermoplastic resin are preferable.

As a thermoplastic resin, an acrylic acid ester based polymer (including copolymer) as described in detail below is preferable.

As a monomer constituting an acrylic acid ester based polymer, there are given a compound esterified between, for example, an acrylic acid or a methacrylic acid, and alkyl alcohol, halogenated alkyl alcohol, alkoxyalkyl alcohol, aralkyl alcohol or alkenyl alcohol. As other resins, there are given polymers (copolymers) obtained from styrene and its derivative.

Further, as a monomer copolymerizable with the foregoing monomer, there are monomers such as an addition polymerizable unsaturated carboxylic acid and its esterified compound, aliphatic monoolefin, conjugated diene based aliphatic diolefin, a nitrogen-containing vinyl compound, vinyl acetates, vinyl ethers, a vinyl silane compound and so forth, and they can be used as the copolymerization component of the foregoing copolymer.

Of these, an acrylic acid, a monopolymer, a copolymer, and a copolymer from styrene and the foregoing as an esterified compound between a methacrylic acid and alkyl alcohol are preferable in view of electrification ability, formability of a coating layer and so forth. As alkyl alcohol, methyl alcohol, ethyl alcohol, propyl alcohol, butyl alcohol, hexyl alcohol, cyclohexyl alcohol, t-butyl alcohol and so forth are preferable.

These acrylic acid ester based polymers having a weight average molecular weight (Mw) of 50,000-1000,000 are preferable, since strength of adhesion to magnetic material particles can be enhanced, whereby durability of carrier can be improved.

Next, a magnetic core material constituting carrier (referred to also as a carrier core) will be described.

Commonly known magnetic core materials can be used as those used in the present invention, but when magnetic particles made of magnetite or ferrite having a true specific gravity of 3-7 g/ml are preferably employed, it is preferable that neither destruction of a coating layer, nor fusing of toner into the carrier surface are generated since stress to which a developer is subjected becomes small during mixture in a developing device while stirring.

(Measurement of Carrier Particle Diameter)

Prior Arrangement:

A developer, a small amount of neutral detergent and water are added into a beaker and blended in the beaker, and the supernatant solution is thrown away while putting a magnet on the bottom of the beaker. Further, are toner and the neutral detergent are removed to separate out only carrier by throwing the supernatant solution away after further adding water. The resulting is dried at 40° C. to obtain carrier as a single body.

Measurement:

The volume average particle diameter is a volume-based average particle diameter which is measured by a laser diffraction type particle size distribution analyzer equipped with a wet disperser, "HELOS" produced by SYMPATEC Corp.

(Method of Manufacturing Carrier)

Next, a method of manufacturing carrier will be described.

The carrier of the present invention can be manufactured by providing a resin coating layer on a magnetic core material.

The resin coating layer of the present invention can be provided on a magnetic core material by commonly known dry process, wet process (a solvent coating method or a solvent immersion method) or the like, but of these, the dry process is preferable in view of manufacturing cost and minimization of environmental load.

The dry process is a method by which thermoplastic particles (binder resin) and a magnetic core material are mixed while heating via drying employing an apparatus shown in FIG. 1, for example, to provide a resin coating layer on the magnetic core material.

FIG. 1 shows a side view of a high-speed stirring mixer equipped with stirring blades as an example of an apparatus to form a resin coating layer on a magnetic core material via drying.

In FIG. 1, numeral 0 represents a main body vessel, 0*a* represents the bottom of the main body vessel, 1 represents the upper lid of the main body, 2 represents a raw material inlet, 3 represents an inlet valve, 4 represents a filter, 5 represents an inspection door, 6 represents a thermometer, 7 represents a jacket, 8 represents a horizontal rotating body, 8*a* and 8*c* represent blades of the horizontal rotating body, 8*d* represents the central part of the horizontal rotating body, 9 represents a vertical rotating body, 20 represents a product outlet, 21 represents an outlet valve, and 22 represents a motor.

Further, a wet process type solvent coating method means a preparation method by which a coating solution composed of a solvent-dissolving solution of a binder resin is coated on a magnetic core material to form a resin coating layer.

[Lubricant]

As a lubricant to exist on the carrier surface, a fatty acid metal salt, for example, can be provided. As a metal salt of fatty acid of the present invention, metal salts of saturated or unsaturated fatty acid generally having at least 10 carbon atoms are preferable. Specific examples of such the metal salt of higher fatty acid include a stearic acid metal salt such as zinc stearate, aluminum stearate, copper stearate, magnesium stearate, calcium steerage or the like; an oleic acid metal salt such as zinc oleate, manganese oleate, iron oleate, copper oleate, magnesium oleate or the like; a palmitic acid metal salt such as zinc palmitate, copper palmitate, magnesium palmitate, calcium palmitate or the like; a linoleic acid metal salt such as zinc linoleate, calcium linoleate or the like; and a recinoleic acid metal salt such as zinc recinoleate and calcium recinoleate.

In the present invention, among fatty acid metal salts, fatty acid metal salt having particularly a high outflow rate measured by a flow tester exhibits high cleavage, and a layer made of fatty acid metal salt can be effectively formed on the photoreceptor surface of the present invention. The outflow rate is preferably $1\times10^{-7}$-$1\times10^{-1}$ (ml/sec), and most preferably $5\times10^{-4}$-$1\times10^{-2}$ (ml/sec). The outflow rate was measured employing Shimadzu Flowtester "CFT-500" (manufactured by Shimadzu Corporation).

Further, a fluorine-containing resin, a polyolefin resin and a paraffin wax are preferably usable.

The situation of "a lubricant present on the carrier surface" in the present invention means a situation where a lubricant is detected when the carrier surface is analyzed with an appropriate analyzer. Examples thereof include a situation where the lubricant is widely extended onto the carrier surface, and coated on the partial or entire surface in the order of several tens of nanometers in thickness; a situation where lubricant particles are embedded in the carrier surface or maintained via crush on the surface; and further, a lubricant is contained in a carrier coating resin, and the lubricant is exposed on a part of the coated surface; and so forth.

A lubricant is detected by the following method.

Prior Arrangement:

A developer, a small amount of neutral detergent and water are added into a beaker and blended in the beaker, and the supernatant solution is thrown away while putting a magnet on the bottom of the beaker. Further, are toner and the neutral detergent are removed to separate out only carrier by throwing the supernatant solution away after further adding water. The resulting is dried at 40° C. to obtain carrier as a single body.

Measurement:

The resulting carrier as a single body was intensively measured in accordance with kinds of lubricants, utilizing the following surface analysis methods.

Examples thereof include electron spectroscopy for chemical analysis (ESCA), Auger electron spectroscopy (Auger), secondary ion mass spectroscopy (SIMS), diffuse reflectance infrared spectrometry FI-IR and so forth.

The presence of a lubricant should be scientifically proved by any of these surface analysis methods.

Next, a method to make a lubricant to be present on the carrier surface will be described.

For example, when a lubricant is widely extended, and firmly attached on the carrier surface, the lubricant is preferably mixed and dispersed in the carrier while stirring, after a coating treatment process of the carrier. The addition amount is preferably 0.05-0.35% by weight, based on the total carrier weight, and more preferably 0.08-0.25% by weight. When the addition amount is designed to be set to an addition amount of 0.05-0.35% by weight, a lubricant is evenly moved onto the photoreceptor surface, whereby high image quality with no generation of blurred image is achieved.

Mixing devices are not specifically limited, and usable examples thereof include a Henschel mixer, a Nauter mixer, a W-cone mixer, a V-type mixer and so forth.

Further, when a lubricant is internally added in a carrier coating layer, the lubricant may be added in an advance in a coating material, and coating is conducted on the carrier with a commonly known method.

[Toner of the Present Invention]

Next, toner of the present invention will now be described.

Though there is no limitation to a method of manufacturing toner particles, those manufactured by separating toner particles from the liquid through solid-liquid separation are preferable. Though the toner particle can be manufactured from any toner particle-dispersion liquid made by any of methods including a suspension polymerization method, an emulsion association method and a dissolution suspension method, those manufactured by an emulsion polymerization association method which provides sharp particle diameter distribution, excellent images and long developer life, are preferable.

A method of manufacturing a toner particle dispersion via emulsion polymerization association will be described below.

A method of manufacturing a toner particle dispersion via emulsion polymerization is a method to form toner particles in an aqueous medium, which is disclosed, for example, in Japanese Patent O.P.I. Publication No. 2002-351142.

Further, there may be given methods to manufacture a toner particle dispersion by salting out and fusing resin particles, disclosed in Japanese Patent O.P.I. Publication Nos. 5-265252, 6-329947 and 9-15904, in an aqueous medium.

Specifically, after dispersing resin particles in water employing an emulsifier, coagulants at critical coagulation concentration or more are added for salting-out, and simultaneously with the foregoing, a particle diameter is caused to grow gradually while forming fused particles by heating and fusing at not less than the glass transition temperature of the resulting polymer itself, and then, growth of particle diameter is stopped by adding a large amount of water when the particle diameter reaches the intended size, and further, a particle surface is smoothed to control its shape while heating and stirring, to prepare the toner particle dispersion. Meanwhile, in this case, a solvent that is infinitely soluble in water such as alcohol may also be added together with the coagulant.

As aqueous media, there are given, for example, water, methanol, ethanol, isopropanol, butanol, 2-methyl-2-butanol, acetone, methyl ethyl ketone, tetrahydrofuran, and a mixture thereof, which, however, are not limited in particular. It is possible to select appropriate ones from those described above for preparation of toner.

As an organic solvent, there are given toluene, xylene and a mixture thereof, which, however, are not limited in particular.

Toner of the present invention is used after so-called external additives are added into toner particles for the purpose of improving fluidity and cleaning ability. These external additives are not specifically limited, but at least inorganic particles are to be utilized.

[Inorganic Particle]

Commonly known inorganic particles can be provided as inorganic particles usable for toner external additives.

Specific examples of preferably usable inorganic particles include particles made of silica, titanium oxide, alumina, tin oxide, magnesium oxide and zinc oxide.

Specific examples of commercially available silica powder include R-805, R-976, R-974, R-972, R-812 and R-809 manufactured by Nippon Aerosil Co., Ltd.; HVK-2150 and H-200 manufactured by Hoechst AG; and TS-720, TS-530, TS-610, H-5 and MS-5 manufactured by Cabot Corporation.

Specific examples of commercially available titanium oxide particles include T-805 and T-604 manufactured by Nippon Aerosil Co., Ltd.; MT-10S, MT-100B, MT-500BS, MT-600, MT-600SS and JA-1 manufactured by TAYCA Corporation; TA-300SI, TA-500, TAF-130, TAF-510 and TAF-510T manufactured by Fuji Titanium Industry Co. Ltd.; and IT-S, IT-OA, IT-OB and IT-OC manufactured by Idemitsu Kosan Co., Ltd.

Specific examples of commercially available alumina particles include RFY-C and C-604 manufactured by Nippon Aerosil Co., Ltd. and TTO-55 and so forth manufactured by Ishihara Sangyo Kaisha, Ltd.

A number average particle diameter of 1-100 nm is preferable, and a number average particle diameter of 3-30 nm is more preferable.

The addition amount of external additives is preferably 0.2-about 5.0% by weight, based on the toner weight.

Examples of an apparatus for adding and mixing external additives in toner particles include commonly known mixers such as a tabular mixer, a Henshel mixer, a Nauter mixer and a V-shaped mixer.

{Measurement of Volume-Based Median Particle Diameter (Volume D50% Diameter) of Toner}

Measurement and calculation are conducted employing an apparatus in which a computer system for data processing (manufactured by BECKMAN COULTER INC.) is connected to Coulter Multisizer III (manufactured by BECKMAN COULTER, INC.)

In measurement procedures, 0.02 g of toner is made to fit in with 20 ml of a surfactant solution (a surfactant solution wherein a neutral detergent containing surfactant components, for example, is diluted with pure water by a factor of 10 for the purpose of dispersing toner), and then, ultrasonic dispersion is conducted for one minute to prepare a toner dispersion. This toner dispersion is introduced, with a pipette, into a beaker having therein ISOTONII (manufactured by BECKMAN COULTER INC.) in a sample stand, until the measured concentration teaches 5-10%, and a meter count is set to 2500 for measurement. In addition, an aperture diameter of 50 μm was used.

(Charging Amount)

The charging amount of toner in a developer sample of the present invention was measured by a charging amount measuring device "Blow-off type TB-200" (manufactured by Toshiba Chemical Corp.).

A charging amount is measured employing a blow-off type charging amount measuring device.

In the blow-off type charging amount measuring device equipped with a stainless steel screen with 400 mesh (for example, TB-200, manufactured by TOSHIBA CORPORATION), nitrogen gas blows for 10 seconds under the condition of a blowing pressure of 50 kPa. A charging amount (μC/g) is calculated by dividing the electric charges obtained through measurement by weight of the scattered toner.

(Photoreceptor of the Present Invention)

Photoreceptors of the present invention will now be described.

Photoreceptors of present invention are not specifically limited, but can be utilized a photoreceptor having a layer structure in which an organic photosensitive layer is provided on a conductive support, and a surface protective layer is provided thereon. The surface protective layer corresponding to a surface protective layer of the present invention plays a role of maintaining of surface hardness of a photosensitive layer and prevention of the contamination caused by foreign mater adhesion. However, there is also another organic photoreceptor in such a way that an outermost layer provided on a photosensitive layer in place of a surface protective layer plays the similar role to that of the surface protective layer. As a matter of course, this is also a surface protective layer of the present invention.

Organic or inorganic filler (particle) is contained in the above-described surface protective layer of the present invention. Particles made of inorganic oxide such as silica, alumina or titanium oxide, or particles made of strontium titanate are preferably employed for the filler contained in the surface protective layer.

Identification and qualification of kinds of filler can be carried out via X-ray photoelectron spectroscopy (XPS) or energy dispersion type X-ray spectroscopy.

In cases where the filler is a metal oxide particle, one strengthened via calcination is preferred. For instance, alumina strengthened via calcination is preferable as alumina to be subjected to a plurality of surface treatments since a hydrophobization treatment is difficult to be conducted in the case of alumina not strengthened via calcination. In the case of alumina strengthened via calcination, one calcined at a temperature of at least 500° C., and preferably at least 1,000° C., is employed in order to produce sufficient strength. The calcination time is preferably at least 5 hours and more preferably at least 10 hours. A functional group such as a hydroxyl group being present on an alumina particle is decomposed by baking alumina under the above-described condition to produce aluminum oxide. Further, as the result, the specific surface area of the alumina particle is reduced, and a surface treatment can be effectively carried out when a hydrophobization treatment is conducted with a silane compound or such.

Filler particles having a number average primary particle diameter of 1-300 nm are preferably employed, and of 3-150 nm are more preferably employed. The number average primary particle diameter is a value of average diameter in the Feret direction obtained via image analysis after observing particles with a transmission electron microscope at a magnification of 10,000 times, and randomly selecting 100 particles as primary particles. When the number average primary particle diameter is at least 1 nm, the filler can be uniformly dispersed in the surface layer and coagulated particles are difficult to be formed. As the result, lowering in image density and blurred images are not generated together with no increase of the remaining potential, and image unevenness caused by a transfer memory and the like is difficult to be generated. On the other hand, in the case of filler having a number average primary particle diameter of at most 300 nm, blurred images and filming are difficult to be generated since there is no large roughness on the surface of a surface layer, and less adhesion of active gases such as ozone and $NO_x$ is observed. Furthermore, in the case of the filler having a number average primary particle diameter of at most 300 nm, not much of precipitation is generated, whereby coagulated particles are to be reduced.

In the present invention, tiller is preferably subjected to a surface treatment.

The surface treatment of the filler can be carried out by a wet process. For example, the filler is dispersed in water to form an aqueous slurry, and the resulting slurry is mixed with a water-soluble silicate, a water-soluble aluminum compound or the like. When sodium silicate is used as the water soluble-silicate, neutralization can be performed with an acid such as a sulfuric acid, a nitric acid, a hydrochloric acid or the like. On the other hand, when aluminum sulfate is used as the water-soluble aluminum compound, neutralization can be performed with alkali such as sodium hydroxide, potassium hydroxide or the like. In the case of a surface treatment with a reactive organic silicon compound, the filler is mixed with a solution in which a reactive organic silicon compound is dissolved or suspended in an organic solvent or water, and the resulting solution is stirred for a few minutes about one hour. The resulting solution is subjected to a heat treatment, if desired, followed by filtration and drying to obtain filler whose surface is covered with the organic silicon compound.

In the case of a surface treatment with a fluorine compound, an organic silicon compound containing a fluorine atom is dissolved or suspended in an organic solvent or water to mix the suspension with metal oxide particles, and the mixed solution is stirred for a few minutes-about one hour. A heat treatment is conducted, followed by filtration and drying, if desired, to obtain filler whose surface is covered with a fluorine compound. In the case of alumina subjected to a plurality of surface treatments in the present invention, a surface treatment to improve dispersibility is conducted for one layer to improve stability of a coating solution containing the foregoing particles. A treatment with silicone oil or a silicone resin, for example, is conducted for another layer to improve lubrication and surface nature.

As a preferable example of a plurality of surface treatments in the present invention, preferable are oxide particles having been subjected to a surface treatment with a halogenated silane as a primary treatment, and to another surface treatment with a silazane compound as the final treatment.

Also preferable are oxide particles having been subjected to a surface treatment with a silicone oil or the like as the primary treatment, and to another surface treatment with a silazane compound as the final treatment. The primary treatment is conducted with halogenated silane or a silicone oil based treatment agent, followed by pulverization of this primarily treated powder, and the pulverized powder is subjected to the secondary surface treatment with an alkylsilazane based treatment agent to obtain oxide particles exhibiting improved hydrophobicity and distribution of the hydrophobicity.

The secondary surface treatment with an alkylsilazane based treatment agent after conducting the primary surface treatment with halogenated silane or a silicone oil based treatment agent and conducting the pulverization treatment may be any of a dry process treatment and a wet process treatment. However, in cases where the order of the primary surface treatment and the secondary surface treatment is replaced, or the kind of a treatment agent, the consumption amount and the treating method employed in the final treatment are inappropriate, hydrophobicity and its distribution are not improved, whereby the object of the present invention cannot be accomplished. Specifically, in cases where the final treatment is conducted with no silazane compound, the surface-treated tends to be released off over time, and the distribution of hydrophobicity is easy to become large.

The hydrophobicity of filler and its distribution can be improved by conducting such the plural surface treatments, and a lubricant can be effectively moved from a carrier, whereby a high quality image with no lack of line image can be obtained.

The foregoing surface layer contains a binder resin assisting dispersibility of the filler. As such the binder resin, polycarbonate or polyallylate is preferable. Polycarbonate or polyallylate preferably has a molecular weight of 10,000-100,000.

The weight ratio of inorganic particles in a surface layer is preferably 5-50 parts by weight, with respect to 100 parts by weight of a binder resin, but is more preferably 6-30 parts by weight. In the case of a weight ratio being less than 5 parts by weight, large wear of the surface layer is generated, and the half tone image is deteriorated since scratches and so forth are generated. In the case of a weight ratio exceeding 50 parts by weight, cracks and so forth are generated since the surface layer tends to be brittle.

Further, a surface layer of the present invention preferably contains a charge transfer material. A hole transfer type (P-type) charge transfer material is preferable usable as charge transfer material (CTM). Examples thereof include a triphenylamine derivative, a hydrazone compound, a styryl compound, a benzidine compound, a butadiene compound and so forth. These charge transfer materials are usually dissolved in a suitable binder resin to conduct layer formation.

The weight ratio of a charge transfer material and a binder resin in the surface layer is preferably of 30-200 parts by weight of the charge transfer material with respect to 100 parts by weight of the binder, but more preferably of 50-150 parts by weight of the charge transfer material with respect to 100 parts by weight of the binder.

In the present invention, an organic photoreceptor means an electrophotographic photoreceptor possessing a structure with an organic compound having at least one of a charge generation function and a charge transfer function which are useful for constituents of the electrophotographic photoreceptor. The organic photoreceptor includes commonly known organic photoreceptors such as a photoreceptor composed of a known organic charge generation material or organic charge transfer material, a photoreceptor containing a polymer complex serving as a charge generation function and a charge transfer function, and so forth.

The constitution of an organic photoreceptor in the present invention is not specifically limited as long as the photoreceptor contains the foregoing surface layer, and the following constitutions are provided;

(1) A charge generation layer and a charge transfer layer are provided in order on a conductive support as the photosensitive layer;
(2) A charge generation layers a first charge transfer layer and a second charge transfer layer are provided in order on a conductive support as the photosensitive layer;
(3) A single layer containing a charge transfer material and a charge generation material is formed on a conductive support as the photosensitive layer;
(4) A charge transfer layer and a charge generation layer are provided in order on a conductive support as the photosensitive layer; and
(5) A surface protective layer is provided on the above-described photosensitive layer in the photoreceptor concerning (1)-(4).

The photoreceptor produced from any of the above constitutions may be applicable. The surface layer in the photoreceptor is a layer being in contact with air, and the photosensitive layer is a surface layer provided that the photosensitive layer composed of a single layer is provided on a conductive support, and the surface protective layer is an outermost surface layer provided that the photosensitive layer composed of a single layer or a multilayer, and a surface protective layer are provided on a conductive support. In the present invention, the above-described constitution (2) is most preferable. A subbing layer (intermediate layer) may be provided on a conductive support before forming the photosensitive layer, even though a photoreceptor of the present invention is applied to any of the constitutions.

The charge transfer layer means a layer having a function of transferring charge carrier generated in a charge generation layer via exposure to light into the surface of an organic photosensitive layer, and specific detection of the charge transfer function can be confirmed by detecting photoconductivity of a sample formed by laminating the charge generation layer and the charge transfer layer on a conductive support.

Next, as to the layer constitution of an organic photoreceptor, the above-described constitution (2) is mainly described.

[Conductive Support]

Both of sheet-shaped and cylinder-shaped conductive supports may be employed as a support usable for a photoreceptor, but the cylinder-shaped one is preferable in view of compact designing of an image forming apparatus.

The cylinder-shaped conductive support means a cylindrical support to form images endlessly via rotation, and a conductive support having a straightness of at most 0.1 mm and a shaking of at most 0.1 mm is preferable. Suitable images are difficult to be formed in the case of these straightness and shaking exceeding the above-described range.

A drum of metal such as aluminum, nickel or the like, a plastic drum on which a conductive material such as aluminum, tin oxide, indium oxide or the like is vapor deposited and a paper-plastic drum on which a conductive material is coated are usable for the conductive material. The conductive support preferably has a specific resistance of at most $10^3$ Ωcm at room temperature. An aluminum support is most preferable as a conductive support of the present invention. Also usable is an aluminum support in which components such as manganese, zinc, magnesium and so forth are mixed in addition to aluminum as a main component.

[Intermediate Layer]

In the present invention, an intermediate layer is preferably provided between a conductive support and a photosensitive layer.

The intermediate layer of the present invention preferably contains N-type semiconductor particles. The N-type semiconductor particles mean particles in which the charge carrier is mainly an electron.

Titanium oxide and zinc oxide are preferable for the N-type semiconductor particles, but titanium oxide is specifically preferable.

As the N-type semiconductor particles, particles having a number average primary particle diameter of 3-200 nm are employed, but particles having a number average primary particle diameter of 5-100 nm are preferably employed.

An intermediate layer coating solution to form an intermediate layer of the present invention is composed of a binder resin and a dispersion solvent in addition to the N-type semiconductor particles made of the foregoing surface-treated titanium oxide or the like.

In such the intermediate layer, 100-200 parts by volume of N-type semiconductor particles are preferably used with respect to 100 parts by volume of a binder resin.

As a binder resin to form a layer structure of the intermediate layer via dispersion of these particles, a polyamide resin is preferable in order to obtain excellent dispersibility of particles, and the following polyamide resin is specifically preferable.

An alcohol-soluble polyamide resin is preferable as a binder resin for an intermediate layer. As the binder resin for the intermediate layer used in an organic photoreceptor, a resin having high solubility in solvent is desired to form the intermediate layer having uniform thickness. A copolymerized polyamide resin or a methoxymethylated polyamide resin having a chemical structure which has few carbon chains between amide bonds such as the foregoing 9-Nylon or the like is known as such the alcohol-soluble polyamide resin.

As the foregoing alcohol-soluble polyamide resin, preferable is a polyamide resin in which 40-100 mol % of a repeating unit structure having 7-30 carbon atoms between amide bonds is contained in the total repeating unit structure.

The intermediate layer preferably has a thickness of 0.3-10 μm. In the case of the intermediate layer having a thickness of less than 0.5 μm, black spots are easy to be generated, and dot images are easily degraded. In the case of the intermediate layer having a thickness exceeding 10 μm, increase of the residual potential is easily generated, and dot images tend to be degraded. The intermediate layer more preferably has a thickness of 0.5-5 μm.

[Photosensitive Layer]

The photosensitive layer constitution of a photoreceptor in the present invention may also be a photosensitive layer constitution as a single layer structure exhibiting a charge generation function and a charge transfer function, provided on the foregoing intermediate layer, but preferable is a structure in which the photosensitive layer function is separated into charge generation layer (CGL) and charge transfer layer (CTL). By taking the constitution in which the functions are separated, the residual potential via repetitive use can be controlled to be minimized, and other electrophotographic properties can be easily controlled in accordance with the purpose. In the case of a negatively charging photoreceptor, a constitution, in which charge generation layer (CGL) is provided on an intermediate layer, and charge transfer layer (CTL) is provided thereon, is preferable.

Next, the photosensitive layer constitution of a function-separating type negatively charging photoreceptor will now be described.

(Charge Generation Layer)

A commonly known charge generation material is usable as charge generation material (CGM) for an organic photoreceptor of the present invention Usable examples thereof include a phthalocyanine pigment, an azo pigment, a perylene pigment, an azulenium pigment and so forth. Of these, preferable is an oxytitanyl phthalocyanine pigment having a maximum peak at Bragg angle 2θ of 27.2° in Cu—Kα X-ray, for example, as CGM with which effects of the present invention are largely produced, and the residual potential via repetitive use can be minimized, When a binder is used as a dispersion medium of CGM for a charge generation layer, a commonly known resin is used as a binder, but most preferable are resins such as a formal resin, a butyral resin, a silicone resin, a silicone-modified butyral resin, a phenoxy resin and so forth. It is preferable that the ratio of a charge generation material to a binder resin corresponds to 20-600 parts by weight with respect to 100 parts by weight of the binder resin. Increase of the residual potential via repetitive use can be minimized by utilizing these resins. The charge generation layer preferably has a thickness of 0.3-2 μm.

[Charge Transfer Layer]

As described before, in the present invention, the charge transfer layer is composed of a plurality of charge transfer layers, and a charge transfer layer as the outermost layer preferably contains metal oxide particles of the present invention.

The charge transfer layer contains charge transfer material (CTM) and a binder resin to disperse CTM and to form a layer, and also contains an antioxidant and the like in addition to the foregoing metal oxide particles as the other material, if desired.

A commonly known hole transfer type (P-type) charge transfer material is preferably usable as charge transfer material (CTM). Examples thereof include a triphenylamine derivative, a hydrazone compound, a styryl compound, a benzidine compound, a butadiene compound and so forth. These charge transfer materials each are usually dissolved in a suitable binder resin to form a layer.

A binder resin used for charge transfer layer (CTL) may be any of a thermoplastic resin and a thermosetting resin.

Examples thereof include polystyrene, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymeric resin containing at least two of the repeating units of the above-described resins. A polymeric organic semiconductor such as poly-N-vinylcarbazole or the like other than these insulating resins is also provided. Among them, most preferable is a polycarbonate resin exhibiting low water absorption together with excellent dispersibility of CTM and excellent electrophotographic properties.

It is preferable that the ratio of a charge transfer material to a binder resin is of 50-200 parts by weight with respect to 100 parts by weight of the binder resin.

The charge transfer layer preferably has a total thickness of 10-40 μm. In the case of a total thickness of less than 10 μm, image unevenness is easy to be generated, and in the case of a total thickness exceeding 40 μm, increase of the residual potential is easy to be generated, and sharpness is also degraded. The surface charge transfer layer as a surface layer preferably has a thickness of 0.5-10 μm.

Examples of the solvent or dispersion medium employed for forming an intermediate layer, a charge generation layer, a charge transfer layer and so forth include n-Butylamine, diethylamine, ethylenediamine, iso-propanolamine, triethanolamine, triethylenediamine, N,N-dimethylformamide, acetone, methyl ethyl ketone, methyl isopropyl ketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide and methyl cellosolve. The present invention is not limited thereto, but An environmental friendly solvent such as tetrahydrofuran, methylethyl ketone or the like is preferably employed. These solvents may also be used singly or as a mixed solvent in combination with at least two kinds.

Next, coat-processing methods such as an immersion coating method, a spray coating method and so forth in addition to a coating method with a slide hopper type coating apparatus are employed as the coat-processing method to prepare an organic photoreceptor. In order to form a surface layer of the present invention, most preferable is a coating method with a circular slide hopper type coating apparatus.

Among the above-described coating solution supplying type coating apparatuses, the coat-processing method with a slide hopper type coating apparatus is most preferable when a dispersion in which the foregoing low boiling point solvent is used is employed as a coating solution, and coating is preferably carried out employing a circular slide hopper type coating apparatus described in Japanese Patent O.P.I. Publication No. 58-189061 in detail in the case of a cylinder-shaped photoreceptor.

In the case of a coating method with a circular slide hopper type coating apparatus, coating can be carried out with no damage of a substrate since the slide surface end and the substrate are placed at an interval of about 2 μm-2 mm, and also with no damage of coated layers even though a plurality of layers each exhibiting a different property are layered. Further, coating can be conducted with almost no elution of the lower layer component to the upper layer side since the duration being in a solvent is very short in comparison to an immersion coating method even though a plurality of layers each exhibiting a different property and dissolving in an identical solvent are layered, and also with no degradation of dispersibility of metal oxide particles in the present invention since coating can be carried out with no elution to a coat tank.

[Developing Method of the Present Invention]

Next, one embodiment of a developing device in the present invention will be described referring to FIG. 2.

The developing method of the present invention is one with a so-called trickle developing system by which toner is newly supplied in response to an amount consumed via development, carrier is also added to gradually replace the carrier in a developing device.

Figure 2:
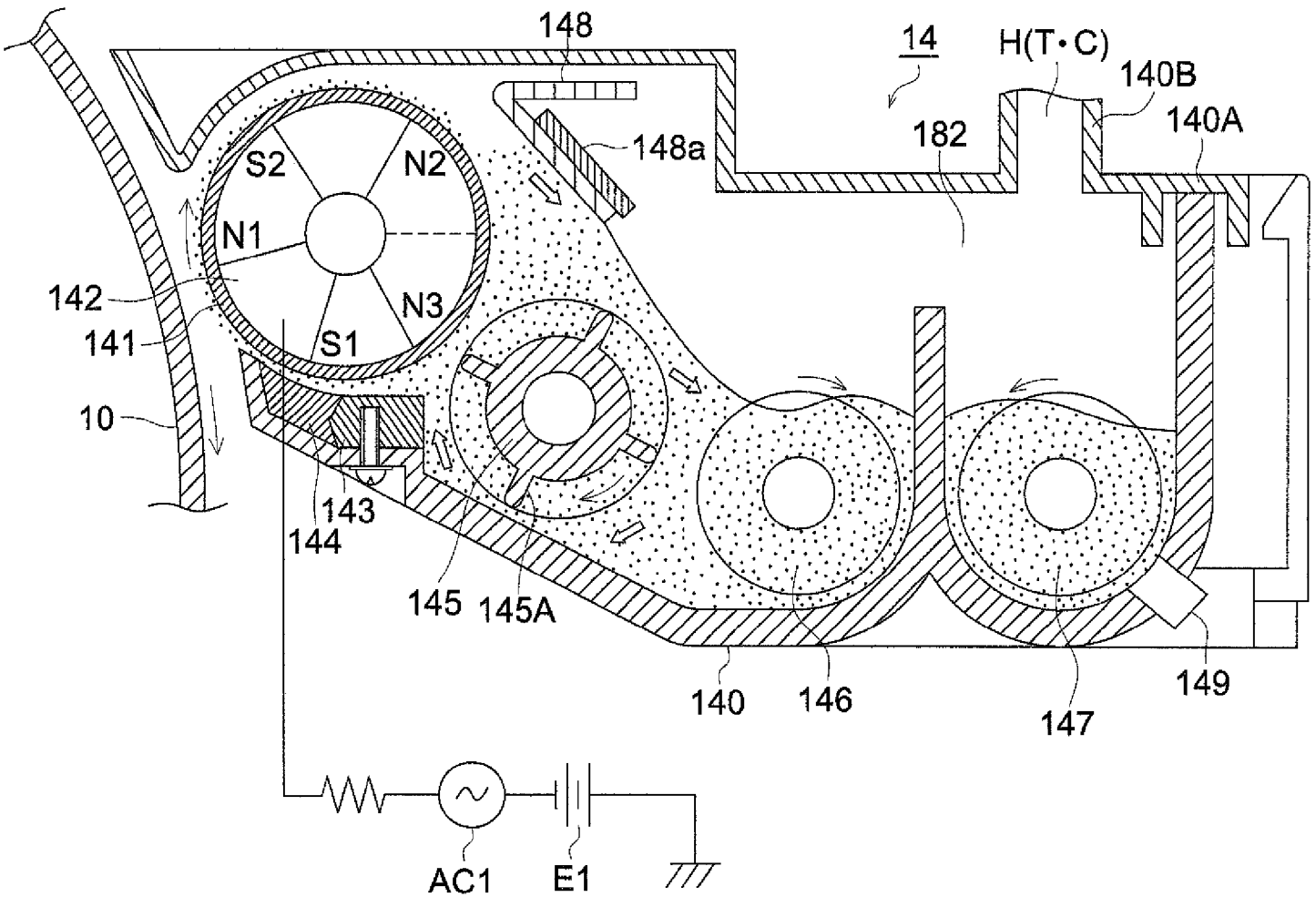
FIG. 2 shows an enlarged cross-sectional view of a developing device.

FIG. 2 shows an enlarged cross-sectional view of a developing device with a trickle developing system in the present invention. In addition, in FIG. 2, arrows each represent the rotation direction of each roller, and thick arrows each represent the conveyance direction of a developer Practically, for example, as to an image forming apparatus shown in FIG. 4, in developing device 14 for each of colors of Y, M, C and K in FIG. 2, developing sleeve 141 possessed by each is provided so as to face the light sensitive surface of photoreceptor drum 10 having an outer diameter of 100 mm, for example.

Developing device 14 as a developing device for each color by which the foregoing two-component developers of yellow (Y), magenta (M), cyan (C) and black (K) are stored is equipped with developing sleeve 141 which rotates in the opposite direction (clockwise direction in FIG. 2) with respect to the rotation direction (clockwise direction in FIG. 2) of photoreceptor drum 10 while keeping the prescribed spacing with respect to the peripheral surface of each photoreceptor drum 10. Developing device 14 as a developing device for each color is constituted as shown below.

In developing device 14, numeral 140 represents a developing device housing as a developer storing section to store a two-component developer composed of toner and carrier, numeral 142 represents a magnet roll as a magnetic field generating means having a fixed magnetic pole, numeral 141 represents a developing sleeve as a developer conveyor having magnet roll 142 inside, numeral 143 represents a layer thickness regulating member as a layer thickness regulating means composed of a magnetic material to regulate thickness of a developer layer on developing sleeve 141, numeral 144 represents a receiving member of a developer composed of a nonmagnetic material, numeral 148 represents a developer-removing plate having magnet plate 148*a* on its back side, numeral 145 represents a conveyance-supply roller, and numerals 146 and 147 represent a pair of stirring screws.

Developing sleeve 141 as a developer conveyor is composed of a nonmagnetic and cylindrical member having an outer diameter of 8-60 mm which is made of, for example, stainless steel, and is rotated in the opposite direction (rotation in the clockwise direction in FIG. 2) with respect to the direction of rotation (rotation in the clockwise direction in FIG. 2) of photoreceptor drum 10 for the peripheral surface of photoreceptor drum 10, while keeping the prescribed spacing by unshown stopper rolls provided on both ends of developing sleeve 141 when the outer diameter is 8 mm or less, it is impossible to form magnetic roll 142 having at least 5 magnetic poles composed of magnetic poles composed of N1, S1, N2, S2 and N3 desired for image formation, and when the outer diameter of developing sleeve 141 exceeds 60 mm, developing device 14 becomes large in size. In particular, in the case of the color printer (refer to FIG. 4) having a plurality of developing devices 14, a volume occupied by the developing device becomes large, resulting in an increase of the outer diameter of photoreceptor drum 10, thus, large-size photoreceptor drum 10 is to make an image forming apparatus to be large in size.

Magnet roll 142 is enclosed in developing sleeve 141, provide a plurality of magnetic poles of N1, N2, N3, S1 and S2 alternately, and is concentrically fixed with developing sleeve 141 to let magnetic force to work on the peripheral surface of a nonmagnetic sleeve.

Layer thickness regulating member 143 as a developer layer thickness regulating means faces magnetic pole N3 of magnet roll 142, and is composed, for example, of a bar-shaped or plate-shaped magnetic stainless material arranged to keep a prescribed spacing from developing sleeve 141 to regulate a layer thickness of the two-component developer on the peripheral surface of developing sleeve 141.

Developer receiving member 144 is composed of a non-magnetic member employing a resin member such as, for example, an ABS resin, and is arranged at the downstream side in the direction of rotation of developing sleeve 141 so as to keep a prescribed spacing from developing sleeve 141 and to adjoin an end surface of layer thickness regulating member 143, so that, it is formed integrally so as to fix onto layer thickness regulating member 143 with an adhesive, and toner is prevented from falling out of the developer layer regulated by layer thickness regulating member 143 to keep the developer layer of the two-component developer stably on the peripheral surface of developing sleeve 141. Developer receiving member 144 may also be formed with developing device housing 140 to be provided to adjoin the end surface of layer thickness regulating member 143.

Developer-removing plate 148 is provided facing magnetic pole N2 of magnet roll 142, and scrapes off the developer on developing sleeve 141 via action of magnetic plate 148*a* provided on the back surface of developer removing plate 148 with repulsion magnetic field of magnetic poles N2 and N3.

Conveyance-supply roller 145 conveys developers scraped off by developer-removing plate 148 to stirring screw 146, and supplies the developer stirred with stirring screw 146 into layer thickness regulating member 143. Symbol 145A is provided with conveyance-supply roller 145, and is a blade portion to convey the developer.

Stirring screws 146 and 147 rotate at a constant speed in the opposite directions to each other, and stir and mix toner and magnetic carrier in developing device 14 to produce the two-component developer containing the prescribed toner components evenly.

The toner and carrier with which the inside of developing device housing 140 is replenished through the after-mentioned toner replenishing port which forms an opening at top plate 140A on the upper portion of developing device housing 140 and of stirring screw 147 become a developer having uniform toner concentration via stirring and mixing with a developer stored in developing device housing 140 with stirring screws 146 and 147 rotating at a constant speed in the opposite directions to each other. The foregoing developer is conveyed to layer thickness regulating member 143 with rotating conveyance-supply roller 145, the prescribed layer thickness is produced by layer thickness regulating member 143, and the developer layer of the two-component developer is supplied onto the outer peripheral surface of developing sleeve 141 stably by receiving member 144. The developer subjected to developing latent images on photoreceptor drum 10 is scraped off via action of magnet plate 148*a* provided on the back surface of developer-removing plate 148 with repulsion magnetic field of magnetic poles N2 and N3, and is conveyed into stirring screw 146 again by conveyance-supply roller 145. Electrostatic latent images on photoreceptor drum 10 are reversely developed through a non-contact developing method via application of a developing bias voltage in which alternate current (AC) bias AC1 is superposed onto direct current (DC) bias E1, if desired.

Though a developing device used for the image forming apparatus of the present embodiment has excellent characteristics exhibiting easy development of high image density together with no fog with a non-contact developing method, but it is desired to employ a two-component developer capable of developing clear images with no fog.

Figure 4:
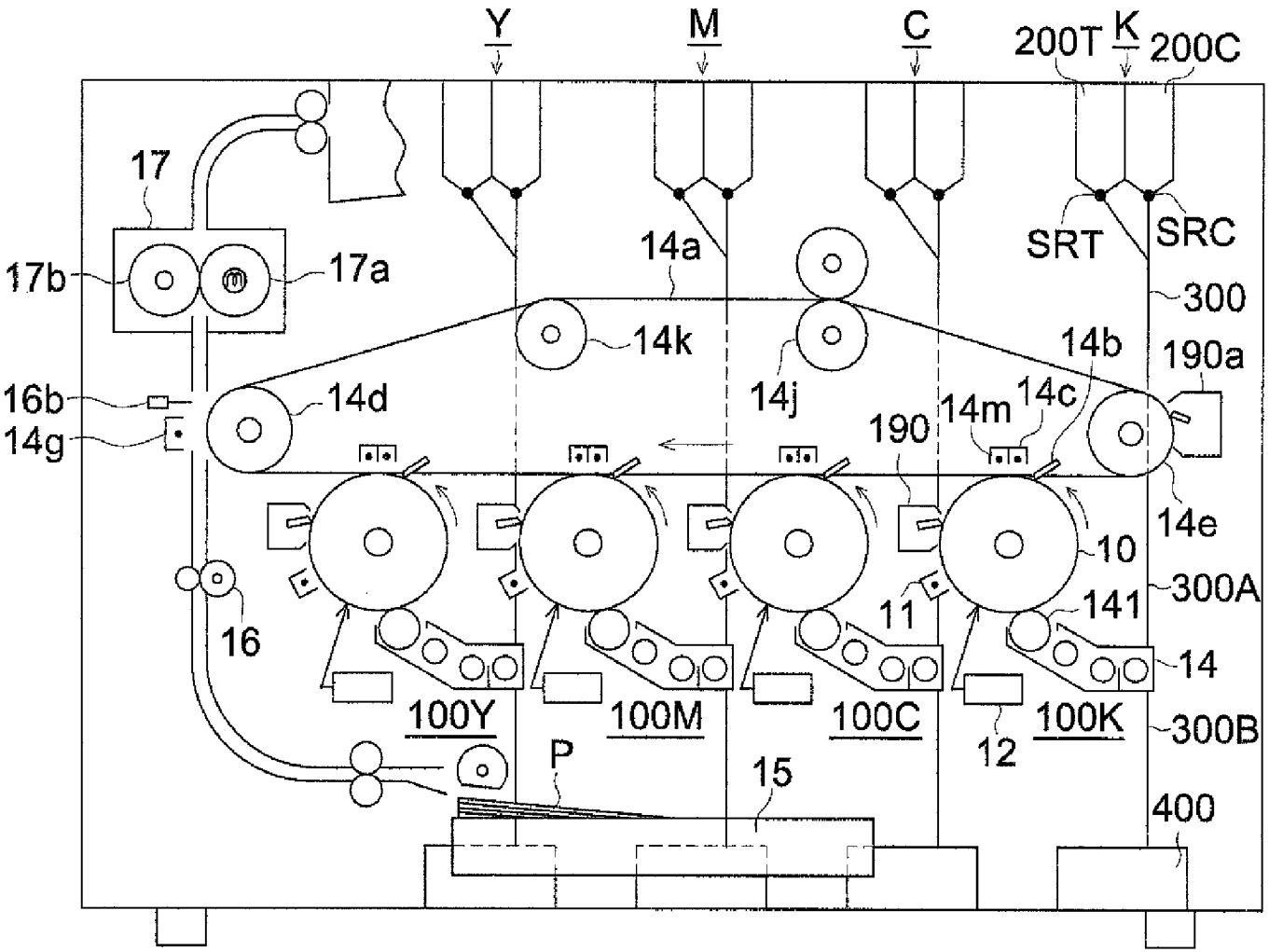
FIG. 4 shows a cross-sectional configuration diagram of a color image forming apparatus equipped with a developing device in the present invention.

Supplying of the developer, that is, toner T and carrier C into developing device 14 is conducted. As to supply of toner T, toner T is supplied when toner density detection sensor 149 detects that the toner density in developing device housing 140 is declined to be lower than the prescribed toner density. On the other hand, as to carrier C, replenishment of new carrier C is appropriately conducted based on the cumulative amount of copy paper sheets. As shown in FIG. 4, developing device 14 is replenished with supplied toner T from hopper 200T as a toner supply means through developer conveyance path 300, and developing device 14 is also replenished with supplied carrier C from hopper 200C as a carrier supply means through the developer conveyance path. Conveyance screw 300A is provided inside developer conveyance path 300 to conduct mixture conveyance of toner T and carrier C.

Replenishing part H (D) of the developer conveyance path to convey the developer via confluence of toner T and carrier C onto the surface located at the end portion on the conveyance upstream side of stirring screw 147 is formed at top place 140A. By such the arrangement, newly supplied toner T or carrier C is sufficiently stirred in a circulating conveyance process with stirring screws 146 and 147, and newly supplied toner T is also charged via stirring and is conveyed into developing sleeve 141 via conveyance.

An amount of toner T newly supplied from hopper 200T approximates to that of toner consumed via development, but an amount of developer in developing device housing 140 is increased via replenishment of carrier C since carrier C newly supplied from hopper 200C is not consumed. To overcome this problem, there is provided the after-mentioned ejection means to eject a two-component developer in which an interface level is excessively increased in the vicinity of the interface corresponding to the prescribed amount of the two-component developer in developing device housing 140.

Figure 3:
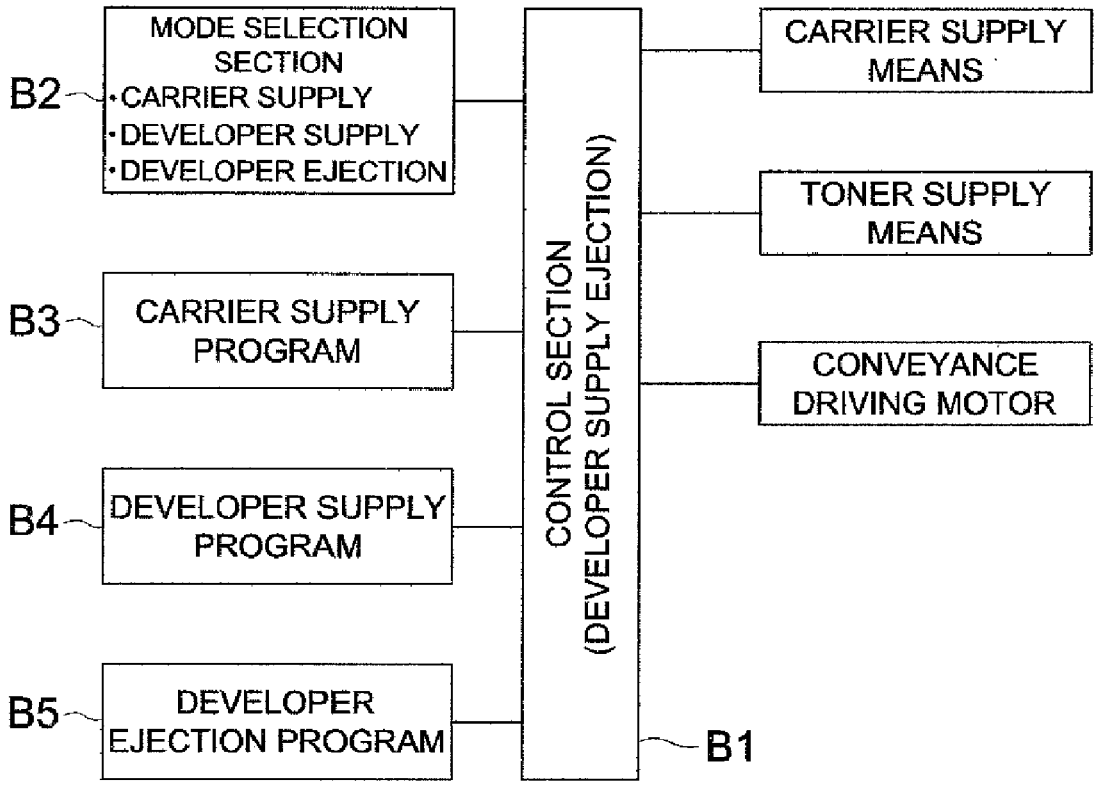
FIG. 3 shows a block diagram of controlling developer supply ejection.

The image forming apparatus of the present embodiment possesses a carrier supply mode to supply carrier together with toner into developing device 14 in accordance with an image forming situation to developing device 14 during the foregoing printing operation; a developer supply mode to supply a developer into developing device 14 before operating the developing device; and a developer ejection mode to eject the developer from developing device 14 after operating the developing device. In FIG. 3, shown is a block diagram of controlling developer supply ejection of an image forming apparatus possessing such the carrier supply mode and developer ejection mode.

Mode selection section B2 is provided in the image forming apparatus, and is usually set to the carrier supply mode during operating the developing device to conduct image formation.

The two-component developer is not contained at all in developing device housing 140 of developing device 14 before newly installing an image forming apparatus and so forth to conduct image formation, namely, before operating a developing device, and the developer supply mode is selected prior to image formation, and the two-component developer in appropriate quantity having an appropriate toner ratio is filled in developing device housing 140. In a situation where a user loads toner T in hopper 200T as a toner storing section, and carrier C is filled in hopper 200C as a carrier storing section, selection and setting of the developer supply mode are performed by mode selection section B2. Control section B1 invokes developer supply process in B4 memorized as ROM to supply an appropriate two-component developer in appropriate quantity into developing device housing 140. In the case of rotation in the positive direction of a conveyance driving motor to drive stirring screws 146 and 147, the prescribed rotation of supplying roller SRC to supply carrier C in hopper 200C, and the prescribed rotation of supplying roller SRT to supply toner T in hopper 200T are conducted. Since an amount of carrier C and an amount of toner T supplied by each single turn of supply rollers SRC and SRT is substantially constant, respectively, the two-component developer in appropriate quantity having an appropriate toner ratio in housing 140 is supplied into developing device 14 through conveyance path 300 by conducting each of the prescribed rotation to be set to the condition for excellent developing while stirring carrier C and toner T dropped to the conveyance upstream position of stirring screw 147.

Incidentally, the above-described explanation relates to a program in which carrier C and toner T are supplied from hopper 200C and hopper 200T, but it is also possible to arrange a program in which a two-component developer having the prescribed toner ratio in hopper 200C, which has already been adjusted, is supplied into developing device housing 140 from hopper 200C by an amount equivalent to a given quantity. It is further possible to arrange a program to stop supplying the two-component developer when an interface level detecting means detects that the two-component developer has been supplied in prescribed quantity, in place of supplying the prescribed amount of two-component developer.

After printing operations, for example, for several tens of thousands of prints, when the two-component developer in developing device housing 140 is desired to be totally ejected for the purpose of replacement, a user conducts selection/setting of the developer ejection mode by mode selection B2. Control section B1 as ROM calls up developer ejection program B5 to eject the two-component developer stored in developer housing 140. In the present embodiment, a conveyance driving motor to drive stirring screws 146 and 147 is inversely rotated via control section B1, and conveyance screw 300B is also rotated in addition. The two-component developer in developing device housing 140 is dropped from opening port 140B via inverse rotation of stirring screw 147, and the dropped two-component developer are conveyed by conveyance screw 300B to be collected in developer collection box 400. As shown in a cross-sectional view of FIG. 2, in developing device 14, the two-component developer is totally ejected when stirring screw 147 is inversely driven continuously, since stirring screw 147 is in a form to be located at the lowest position in the developing device housing.

Developing device 14 described above is independently controlled for each of developing devices 14 of Y, M, C and K in the case of a color printer.

In the present invention, easy mounting and dismounting of a developing device are not necessarily required, since supply of the two-component developer to a developing device and ejection of the two-component developer are carried out under the condition that the developing device is set on an image forming apparatus, although the developing device has been desired to be unitized in the past so that it may easily be dismounted from the image forming apparatus.

The control of supply and ejection of the developer described in the embodiment generates excellent effects when it is applied to a developing device such as a color printer. Even though the control is applied to developing device 14 of a tandem type color image forming apparatus shown in FIG. 4, the identical effects are generated. Therefore, such the tandem type color image forming apparatus will be explained

[Image Forming Method and Image Forming Apparatus]

The color image forming apparatus shown in FIG. 4 is a tandem type color image forming apparatus, in which a plurality of image forming bodies are arranged in parallel, and their structures and functions are as follows. On the peripheral portion of transfer belt 14*a* as an intermediate transfer member, there are provided four sets of process units 100 formed from yellow (Y), magenta (M), cyan (C) and black (K), and each toner image of Y, M, C and K each being a single color formed by each process unit 100 is transferred to be superposed on transfer belt 14*a*, and transferred color toner images are transferred all together on a recording paper sheet as a transfer material, to be fixed and ejected outside the apparatus.

Numeral 10 represents a photoreceptor drum as an image forming body for each color, 11 represents a scorotron charging device as a charging means for each color, 12 represents an exposure optical system as an image writing means for each color, 14 represents a developing device for each color, and 190 represents a cleaning device as a cleaning means for photoreceptor drum 10 for each color.

Photoreceptor drum 10 as an image forming body for each color receives driving force from transfer belt 14*a* when transfer belt 14*a* under the state of contact moves to be driven to rotate, and photoreceptor drum 10 for each color is rotated in the direction indicated with an arrow in the figure, under the state of grounding.

Scorotron charging device 11 as a charging means for each color conducts charging actions (negative charging in the present embodiment) by control grids each being kept to prescribed electric potential and by corona discharge having the identical polarity (negative polarity in the present embodiment) as that of toner (toner in the case of developing) used by a corona discharge electrode, and gives uniform electric potential to photoreceptor drum 10. As a corona discharge electrode of scorotron charging device 11, it is also possible to employ other electrodes such as a serrated electrode or a needle electrode.

Exposure optical system 12 as an image writing means for each color is placed around photoreceptor drum 10 in such a way that an exposure position on photoreceptor drum 10 may come to the downstream side in the rotation direction of photoreceptor drum 10 for scorotron charging device 11 for each color mentioned above. Exposure optical system 12 gives imagewise exposure to a photoreceptor layer of photoreceptor drum 10 in accordance with image data of each color acquired through reading by a separate image reading device and through storing in a memory, and forms an electrostatic latent image on photoreceptor drum 10 for each color.

Developing device 14 as a developing means for each color keeps a prescribed spacing from a circumferential surface of photoreceptor drum 10 as described before by using FIG. 2; has developing sleeve 141 formed by a cylindrical and non-magnetic stainless steel material or aluminum material having a thickness of 0.5-1 mm and an outer diameter of 15-25 mm that rotates in the same direction as in the rotating direction of photoreceptor drum 10; and stores therein the two-component developer of each of yellow (Y), magenta (M), cyan (C) and black (K) in accordance with development color for each color. Developing device 14 is kept by unshown stopper rolls to be away from photoreceptor drum 10 by a prescribed spacing, for example, of 100-500 μm, and when direct-current voltage or development bias voltage in which direct-current voltage and alternating-current voltage are superposed each other is applied onto developing sleeve 141, contact reversal development is conducted in a state where the developer carried on the circumferential surface is bristle-like to form a toner image on photoreceptor drum 10.

Image-wise exposure is conducted by exposure optical system 12 to form an electrostatic latent image on photoreceptor drum 10 evenly charged with scorotron charging device 11, followed by development with developing device 14 to form a toner image. At a transfer position, this toner image is transferred onto the after-mentioned transfer belt 14*a*. Residual toner on the drum after the transfer operation is cleaned with cleaning device 190 to electrostatically conduct collection for cleaning.

Transfer belt 14*a* facing four color process units 100Y, 100M, 100C and 100K in parallel is an endless belt having a volume resistance of $10^{12}$-$10^{15}$ Ω·cm, and is a two-layer structured seamless belt where fluorine coating with a thickness of 5-50 μm is preferably provided as a toner filming prevention layer, on the outside of a semiconductive film substrate having a thickness of 0.1-1.0 mm in which a conductive material is dispersed in engineering plastic such as, for example, modified polyimide, thermosetting polyimide, an ethylene tetrafluoroethylene copolymer, polyvinylidene fluoride or a nylon alloy. As a substrate of transfer belt 14*a*, a semiconductive rubber belt having a thickness of 0.5-2.0 mm in which a conductive material is dispersed in silicone rubber or urethane rubber can also be employed Transfer belt 14*a* is passed through driving roller 14*d*, driven roller 14*e*, tension roller 14*k* and backup roller 14*j* on a circumscribing basis, and during image formation, driving roller 14*d* is driven by an unshown driving motor to rotate, then, transfer belt 14*a* is pushed against photoreceptor drum 10 by pressing elastic plate 14*b* arranged at the upstream side of the transfer position for each color, and transfer belt 14*a* is rotated in the arrow direction in the drawing. In this case, photoreceptor drum 10 is driven to rotate by driving force of transfer belt 14*a* in conjunction with movement of transfer belt 14*a*.

Primary transfer device 14*c* as a transfer means for each color is preferably composed of a corona discharge device, and is provided facing photoreceptor drum 10 for each color with transfer belt 14*a* in between, to form a transfer area (having no sign) for each color between transfer belt 14*a* and photoreceptor drum 10 for each color. A direct-current voltage with polarity opposite to that of toner (positive polarity in the present embodiment) is applied to primary transfer device 14*c* for each color, and a toner image on photoreceptor drum 10 for each color is transferred onto transfer belt 14*a* by forming a transfer electric field in the transfer area.

Charge-removing device 14*m* as a charge-removing means for each color is preferably composed of a corona discharge device, and neutralizes transfer belt 14*a* charged with primary transfer device 14*c*.

Pressing elastic plate 14*b* as a pressing means of the transfer belt is formed with a rubber blade such as urethane to be arranged at the upstream side of the transfer position for each color, and transfer belt 14*a* is pressed against photoreceptor drum 10 during image formation to rotate photoreceptor drum 10 in conjunction with movement of transfer belt 14*a*.

At the start of image recording, photoreceptor drum 10 of image forming unit 100K for black (K) is rotated in the arrow direction in the drawing, via starting of an unshown photoreceptor drive motor, and at the same time, charging operation of scorotron charging device 11 start providing potential to photoreceptor drum 10 for K.

After providing potential to photoreceptor drum 10 for K, image writing with electrical signals corresponding to the first color signals, namely, to image data of K is started by exposure optical system 12 of K, and an electrostatic latent image corresponding to an image of K of a document image is formed on the surface of photoreceptor drum 10 for K.

The foregoing latent image is subjected to contact type reversal development employing developing device 14 of K, and a toner image of black (K) is formed by rotation of photoreceptor drum 10 for K.

A toner image of K formed on photoreceptor drum 10 for K as an image forming body by the above-described image forming process is transferred onto transfer belt 14*a* in the transfer area of K (having no sign) by primary transfer device 14*c* of K as the first transfer means.

Then, transfer belt 14*a* is synchronized with a toner image of C, potential is given by image forming unit 100C of cyan (C) through electrification of scorotron charging device 11 of C, and image writing by electric signals corresponding to the second color signals, namely, to image data of C is conducted by exposure optical system 12 of C, thus, toner image of C is transferred onto photoreceptor drum 10 of C by contact type reversal development with developing device 14 of C, and toner image of C is superposed on the foregoing toner image of K by primary transfer device 14*c* of C as the first transfer means in the transfer area (having no sign) of C.

In the identical process, synchronization is made with superposed toner images respectively of K and C, and, a toner image of M corresponding to image data of M by the third color signal which are formed on photoreceptor drum 10 for M by image forming unit 100M of magenta (M) is formed by primary transfer device 14*c* of M as the first transfer means, in the transfer area (having no sign) of M, to be superposed on the foregoing toner images respectively of K and C, and further, synchronization is made with superposed toner images respectively of K, C and M, and, a toner image of Y corresponding to image data of Y by the fourth color signal which are formed on photoreceptor drum 10 of Y by image forming unit 100Y of yellow (Y) is formed by primary transfer device 14*c* of Y as the first transfer means, in the transfer area (having no sign) of Y, to be superposed on the foregoing toner images respectively of K, C and M, thus, a color toner image composed of superposed images respectively for K, C, M and Y is formed on transfer belt 14*a*.

The transfer residual toner remaining on a circumferential surface of photoreceptor drum 10 for each color after transfer is cleaned with cleaning device 190 as a cleaning means for an image forming body for each color.

Recording sheet P is conveyed to transfer area (having no sign) of the second transfer device 14*g* as the second transfer means via timing roller 16 as a transfer sheet feeding means from sheet cassette 15 as a transfer material storing means, in synchronization with formation of superposed color toner images on transfer belt 14*a*, and superposed color toner images on the transfer belt 14*a* are transferred all together onto recording sheet P with secondary transfer device 14*g* to which direct-current voltage having polarity opposite to that of toner (positive polarity in the present embodiment) is applied.

Recording sheet P onto which the color toner image has been transferred is electrically neutralized by charge-removing electrode 16*b* as a separating means composed of a serrated electrode plate, and then, conveyed to fixing device 17 where heat and pressure are applied to recording sheet P in the place between fixing roller 17*a* and pressure roller 17*b* so that a toner image on recording sheet P may be fixed, thus, recording sheet P is ejected to a tray located outside the apparatus.

The transfer residual toner remaining on a circumferential surface of transfer belt 14*a* after transfer is cleaned by cleaning device 190*a* as a cleaning means for a transfer belt provided facing driven roller 14*e* with transfer belt 14*a* in between.

Developing device 14 as a developing means for each color stores each two-component developer for each of yellow (Y), magenta (M), cyan (C) and black (K), and is equipped with developing sleeve 141 which rotates in the rotation direction of photoreceptor drum 10 at the developing position while keeping a prescribed spacing from a circumferential surface of each of photoreceptor drums 10.

Developing device 14 as a developing means for each color is of the structure identical to one explained referring to FIG. 2, and carrier C in hopper 200C is supplied to developing device 14 by rotation of supply roller SRC provided below hopper 200C, and toner T is also supplied to developing device 14 by rotation of supply roller SRC provided below hopper 200T. Further, the two-component developer ejected from developing device 14 is conveyed by conveyance screw 300B to be collected in developer collection box 400. Employing an image forming apparatus having such the structure, by providing a carrier supply mode to supply carrier to developing device 14 during printing operation, a developer supply mode to supply developer to developing device 14 before operating the developing device and/or a developer ejection mode to eject developer from the developing device after operating the developing device, it is possible to replace the two-component developer entirely, without dismounting developing device 14 from the image forming apparatus, which has made services done by a serviceperson including developer replacement and so forth unnecessary.

[Recording Material]

The recording material of the present invention is a support to hold toner images, and is usually called an image support, a transfer material or a transfer sheet. Specifically, there are given various transfer materials including an ordinary sheet including a thin sheet to a thick sheet, coated printing paper such as art paper and coated paper, Japanese paper and postcard paper which are commercially available, plastic film for OHP and a textile, but the present invention is not limited thereto.

Example

The present invention is further described in accordance with its typical embodiments.

In addition, "part" represents "part by weight".

[Preparation of Photoreceptor]

(Preparation of Photoreceptor 1)

<Intermediate Layer 1>

The following intermediate layer coating solution was coated on a washed circular aluminum substrate by an immersion coating method, and dried at 120° C. for 30 minutes to form intermediate layer 1 having a dry thickness of 5 μm.

The following intermediate layer dispersion was diluted two times with the same mixed solvent, and it was left standing overnight. Then it was filtered by a filter (RIGIMESH produced by Nihon Pall Corp., with a filtration accuracy of 5 μm and a pressure of 50 kPa) to prepare the intermediate layer coating solution.

| | |
|---|---|
| Polyamide resin CM8000 (produced by Toray Inductries, Inc.) | 1 part |
| Titanium oxide SMT500SAS (Tayca Inc.) | 3 parts |
| Methanol | 10 parts |

Dispersing was conducted for 10 hours employing a batch type sand mill as a homogenizer.

| <Charge generation layer 1> | |
|---|---|
| Charge generation material (CGM): Oxytitanyl phthalocyanine {a titanyl phthalocyanine pigment having a maximum diffraction peak at a Bragg angle of 27.3° (2θ ± 0.2°) in X-ray diffraction spectrum with Cu-Kα characteristic X-ray} | 24 parts |
| Polyvinyl butyral resin (S-Lec BL-1, produced by Sekisui Chemical Co., Ltd.) | 12 parts |
| 2-butanone/cyclohexanone in a volume ratio of 4:1 | 300 parts |

The above-described composition was mixed and dispersed employing a sand mill to prepare a charge generation layer coating solution. This coating solution was coated with an immersion coating method to form charge generation layer 1 having a dry thickness of 0.5 μm on the foregoing intermediate layer.

| <Charge transport layer 1> | |
|---|---|
| Charge transport material [N-(4-methylphenyl)-N-{4-β-phenylstyryl}phenyl}-p-toluidine] | 225 parts |
| Polycarbonate (Z300, produced by Mitsubishi Gas chemical Company, Ltd.) | 300 parts |
| Antioxidant (Irganox1010, produced by Nihon Ciba-Geigy K.K.) | 6 parts |
| Dichloromethane | 2000 parts |
| Silicone oil (KF-54, produced by Shin-Etsu Chemical Co., Ltd.) | 1 part |

The above-described composition was mixed, and dissolved to form charge transport layer coating solution 1. This coating solution was coated on the foregoing charge generation layer by an immersion coating method to form charge transport layer 1 having a thickness of 20.0 μm.

| <Surface protective layer 1> | |
|---|---|
| Filler: silica particles (silica having an average primary particle diameter of 50 nm having subjected to a surface treatment with dimethyldichlorosilane during the primary treatment, and with hexamethyldisilazane during the secondary treatment) | 30 parts |
| Charge transport material [N-(4-methylphenyl)-N-{4-β-phenylstyryl}phenyl}-p-toluidine] | 150 parts |
| Polycarbonate (Z300, produced by Mitsubishi Gas Chemical company, Ltd.) | 300 parts |
| Antioxidant (Irganox1010, produced by Nihon Ciba-Geigy K.K.) | 12 parts |
| Tetrahydrofuran: THF | 2800 parts |
| Silicone oil (KF-54, produced by Shin-Etsu Chemical Co., Ltd.) | 4 part |

The above-described composition was mixed, and dissolved to form a surface protective layer coating solution. This coating solution was coated on the foregoing charge transport layer 1 with a circular slide hopper type coating apparatus, and dried at 110° C. for 70 minutes to form surface protective layer 1 having a dry thickness of 6.0 μm, and then to prepare photoreceptor 1.

(Preparation of Photoreceptor 2)

Photoreceptor 2 was prepared similarly to preparation to photoreceptor 1, except that filler of the surface protective layer was replaced by alumina particles, which have been subjected to a surface treatment, having an average primary particle diameter of 100 nm.

(Preparation of Photoreceptor 3)

Photoreceptor 3 was prepared similarly to preparation to photoreceptor 1, except that filler of the surface protective layer was replaced by titanium oxide particles, which have been subjected to a surface treatment, having an average primary particle diameter of 20 nm.

(Preparation of Photoreceptor 4)

Photoreceptor 4 was prepared similarly to preparation to photoreceptor 1, except that filler of the surface protective layer was replaced by strontium titanate particles, which have been subjected to a surface treatment, having an average primary particle diameter of 500 nm.

(Preparation of Photoreceptor 5)

Photoreceptor 5 was prepared similarly to preparation to photoreceptor 1, except that filler of the surface protective layer was replaced by polytetrafluoroethylene (PTFE) particles subjected to no surface treatment, having an average primary particle diameter of 100 nm.

(Preparation of Photoreceptor 6)

Photoreceptor 6 was prepared similarly to preparation to photoreceptor 1, except that silica particles in the surface protective layer were replaced by silica particles subjected to no surface treatment, having an average primary particle diameter of 50 nm.

(Preparation of Comparative Photoreceptor 1)

Comparative photoreceptor 1 was prepared similarly to preparation to photoreceptor 1, except that no surface protective layer was provided, and charge transport layer 1 was arranged to have a layer thickness of 26.0 μm.

The relationship with filler employed for photoreceptors 1-6 and comparative photoreceptor 1 is shown in the following Table 1.

TABLE 1

| | Filler | | |
|---|---|---|---|
| Sample No. | Kinds | Particle diameter | Surface treatment |
| Photoreceptor 1 | Silica | 50 nm | Silazane treatment |
| Photoreceptor 2 | Alumina | 100 nm | Silazane treatment |
| Photoreceptor 3 | Titanium oxide | 20 nm | Silazane treatment |
| Photoreceptor 4 | Strontium titanate | 500 nm | Silazane treatment |
| Photoreceptor 5 | PTFE | 100 nm | No surface treatment provided |
| Photoreceptor 6 | Silica | 50 nm | No surface treatment provided |
| Comparative photoreceptor 1 | No filler provided | | |

{Preparation of Developer (Two-Component Developer)}

(Preparation of Developer 1)

(1) Preparation of Toner (Preparation of Toner Base Particle)

Toner base particles are prepared in conventional procedures by the polymerization method, that is, prepared via preparation of resin particles by the first step polymerization, the second step polymerization and the third step polymerization, preparation of colorants, coagulation, a fusing step, washing, and a drying step.

(External Additive Treatment for Toner)

Into toner base particles, added were 0.8% by weight of hydrophobic silica having a number average primary particle diameter of 12 nm and 0.6% by weight of hydrophobic titania having a number average primary particle diameter of 20 nm, and the resulting was mixed with a Henschel mixer to prepare toner 1 having a volume average median particle diameter of 5.6 μm.

(2) Preparation of Carrier

{Preparation of Carrier Core (Core Material)}

The composition was arranged to be set by adding calcium carbonate and magnesium chloride so as to give a mixture ratio of $Fe_2O_3$:MgO being 60 mol %:40 mol %. To the composition, added were 1% by weight of binder and water to make a slurry having a concentration of 60% by weight, and the resulting was subsequently pulverized with a wet type ball mill and was subjected to a spray dryer treatment to obtain dry particles. Then, the dry particles were calcined in a calcination furnace at 1150° C. under the ambient atmosphere, and carrier core 1 made of ferrite was obtained via sieving of the particles.

(Preparation of Carrier Particle)

Hundred parts by weight of carrier core 1 and 5 parts by weight of copolymer resin particles of cyclohexylmethcrylate/methylmethacrylate (a copolymerization ratio of 5/5) were charged in a high speed mixer fitted with stirring blades, the resulting was mixed while stirring at 120° C. for 30 minutes, and a resin coating layer was formed on the surface of carrier core 1 via action of mechanical impact force, thus to obtain carrier particle 1.

Into carrier 1, added was 0.15% by weight of zinc stearate as a lubricant, and the resulting was mixed at a blade rotation of 300 rpm for 5 minutes employing a Henshel mixer to prepare carrier 1 having a volume average particle diameter of 30 μm.

(3) Preparation of Developer

Carrier 1 and toner 1 were charged in a micro-type V-mixer (manufactured by TSUTSUI RIKAGAKU Co. Ltd.), and mixed at 45 rpm for 30 minutes so as to make a toner concentration of 8% by weight to prepare developer 1.

(Preparation of Developer 2)

Developer 2 was prepared similarly to preparation of developer 1, except that the volume average median particle diameter of toner was replaced by 4.5 μm, and the content of a lubricant existing on a carrier was replaced by 0.1% by weight of fluorine particles (polytetrafluoroethylene: PTFE).

(Preparation of Developer 3)

Developer 3 was prepared similarly to preparation of developer 1, except that the content of a lubricant existing on a carrier was replaced by 0.35% by weight of polypropylene particles, and the volume average particle diameter of carrier was replaced by 22 μm.

(Preparation of Developer 4)

Developer 4 was prepared similarly to preparation of developer 1, except that the content of a lubricant was replaced by 0.2% by weight of paraffin wax, and the volume average particle diameter of carrier was replaced by 38 μm.

(Preparation of Developer 5)

Developer 5 was prepared similarly to preparation of developer 1, except that the content of a lubricant was replaced by 0.25% by weight of molybdenum disulfide.

(Preparation of Developer 6)

Developer 6 was prepared similarly to preparation of developer 1, except that the volume average median particle diameter of toner was replaced by 6.5 μm.

(Preparation of Developer 7)

Developer 7 was prepared similarly to preparation of developer 1, except that the volume average median particle diameter of toner was replaced by 2.8 μm, and the volume average particle diameter of carrier was replaced by 18 μm.

(Preparation of Developer 8)

Developer 8 was prepared similarly to preparation of developer 1 except that the volume average median particle diameter of toner was replaced by 8.5 μm, and the volume average particle diameter of carrier was replaced by 45 μm.

(Preparation of Developer 9)

<Preparation of Carrier>

Hundred parts by weight of carrier core 1, 5 parts by weight of copolymer resin particles of cyclohexylmethcrylate/methylmethacrylate (a copolymerization ratio of 5/5) and 0.2 parts by weight of zinc stearate were charged in a high speed mixer fitted with stirring blades, mixed at 120° C. while stirring for 30 minutes, and a resin coating layer was formed on the surface of carrier core 1 via action of mechanical impact force, thus, to obtain carrier 2.

Carrier 2 and toner 1 were charged in a micro-type V-mixer (manufactured by TSUTSUI RIKAGAKU Co. Ltd.), and mixed at 45 rpm for 30 minutes so as to make a toner concentration of 8% by weight to prepare developer 9.

(Preparation of Comparative Developer 1)

Carrier particle 1 (no lubricant present on the surface) and toner 1 were charged in a micro-type V-mixer (manufactured by TSUTSUI RIKAGAKU Co. Ltd.), and mixed at 45 rpm for 30 minutes so as to make a toner concentration of 8% by weight to prepare comparative developer 1.

(Preparation of Comparative Developer 2)

(External Additive Treatment for Toner)

Into toner base particles, added were 0.8% by weight of hydrophobic silica having a number average primary particle diameter of 12 nm, 0.6% by weight of hydrophobic titania having a number average primary particle diameter of 20 nm and 0.15% by weight of zinc stearate, and the resulting was mixed with a Henschel mixer to prepare toner 2 having a volume average median particle diameter of 5.6 μm.

Carrier particle 1 (no lubricant present on the surface) and toner 2 were charged in a micro-type V-mixer (manufactured by TSUTSUI RIKAGAKU Co. Ltd.), and mixed at 45 rpm for 30 minutes so as to make a toner concentration of 8% by weight to prepare comparative developer 2.

The addition amount and preparation conditions of the above-described developers 1-9 and comparative developers 1 and 2 are shown in the following Table 2.

TABLE 2

| | Toner | | Carrier | | | |
|---|---|---|---|---|---|---|
| Sample No. | Volume-based average median particle diameter | Externally added lubricant | Volume-based average particle diameter | Kinds of lubricants | Addition | Addition amount |
| Developer 1 | 5.6 μm | Not provided | 30 μm | Zinc stearate | Added externally on the surface | 0.15% by weight |
| Developer 2 | 4.5 μm | Not provided | 30 μm | Fluorine particle | Added externally on the surface | 0.1% by weight |
| Developer 3 | 5.6 μm | Not provided | 22 μm | Polypropylene particle | Added externally on the surface | 0.35% by weight |
| Developer 4 | 5.6 μm | Not provided | 38 μm | Paraffin wax | Added externally on the surface | 0.2% by weight |
| Developer 5 | 5.6 μm | Not provided | 30 μm | Molybdenum disulfide | Added externally on the surface | 0.25% by weight |
| Developer 6 | 6.5 μm | Not provided | 30 μm | zinc stearate | Added externally on the surface | 0.15% by weight |
| Developer 7 | 2.8 μm | Not provided | 18 μm | zinc stearate | Added externally on the surface | 0.15% by weight |
| Developer 8 | 8.5 μm | Not provided | 45 μm | zinc stearate | Added externally on the surface | 0.15% by weight |
| Developer 9 | 5.6 μm | Not provided | 30 μm | zinc stearate | Added internally in coating layer | 0.2% by weight |
| Comparative developer 1 | 5.6 μm | Not provided | 30 μm | Not provided | — | — |
| Comparative developer 2 | 5.6 μm | 0.15% by weight of zinc stearate | 30 μm | Not provided | — | — |

[Performance Evaluation]

The resulting photoreceptors and developers were fitted into a copy machine in which a commercially available color copier (bizhub C550, manufactured by Konica Minolta Business Technologies, Inc.) was remodeled as a trickle developing system, and were evaluated. (The developing device and image forming apparatus were arranged similarly to configuration diagrams shown in FIGS. 2-4.) In addition, in the case of the trickle development, there is an outlet at the lower portion of a vessel, and respectively installed are a toner hopper capable of containing 300 g of toner and a carrier hopper capable of containing 500 g of carrier which control a supply amount by adjusting screw rotation. Toner and carrier ejected from the toner hopper and the carrier hopper, respectively, are charged into a developer stirring mechanism, mixed in the mechanism, and supplied into a developing device. In order to convey a developer to the inside of the developing device, a developer ejection mechanism composed of an ejection path formation member, a developer outlet and a developer ejection conveyance member is provided as a part of the developing device so as to be able to discharge the developer from the outlet. The ejected amount was controlled via rotation speed of the developer ejection conveyance member. Further, the developer ejected from the outlet was stored in a waste developer box through an ejection path.

[Evaluation of Lack of Line Image]

Evaluations were made under the environmental conditions of LL (10° C. and 20% RH), NN (25° C. and 60% RH) and HH (33° C. and 80% RH).

Evaluations were made with an installed lattice-pattern image after outputting the forgoing 100,000 prints.

Evaluation Criteria

A: No lack of line image is observed at all.

B: Lack of line image is slightly observed, and slightly visible to the naked eye.

C: Lack of line image is observed, and clearly visible to the naked eye.

[Evaluation of Halftone Image]

The photoreceptor surface was visually observed after printing the foregoing 100,000 copies, and at the same time, the correlation with image defects of an output halftone image was evaluated.

Evaluation Criteria

A: Streaks and filming of toner and external additives are seldom generated on the photoreceptor surface, and no correlated image defect is also generated.

B: Streaks and filming are generated on the photoreceptor surface, but no correlated image defect is generated.

C: Not only streaks and filming are largely generated on the photoreceptor surface, but also correlated image defects are generated.

TABLE 3

| Evaluation No. | Photoreceptor | Developer | Lack of line image | Halftone |
|---|---|---|---|---|
| Example 1 | Photoreceptor 1 | Developer 1 | A | A |
| Example 2 | Photoreceptor 1 | Developer 2 | A | B |
| Example 3 | Photoreceptor 1 | Developer 3 | A | B |
| Example 4 | Photoreceptor 1 | Developer 4 | B | A |
| Example 5 | Photoreceptor 1 | Developer 5 | B | B |
| Example 6 | Photoreceptor 2 | Developer 6 | A | A |
| Example 7 | Photoreceptor 3 | Developer 7 | B | B |
| Example 8 | Photoreceptor 4 | Developer 8 | B | B |
| Example 9 | Photoreceptor 1 | Developer 9 | B | B |
| Example 10 | Photoreceptor 5 | Developer 1 | B | B |
| Example 11 | Photoreceptor 6 | Developer 1 | B | B |
| Comparative example 1 | Photoreceptor 1 | Comparative developer 1 | C | C |
| Comparative example 2 | Photoreceptor 1 | Comparative developer 2 | C | C |
| Comparative example 3 | Comparative photoreceptor 1 | Developer 1 | C | B |
| Comparative example 4 | Comparative photoreceptor 1 | Comparative developer 1 | C | C |

As is clear from Table 3, it is to be understood that Examples 1-11 of the present invention exhibit no problem of any of the properties, but Comparative examples 1-4 exhibit a problem of at least one of the properties.

EFFECT OF THE INVENTION

In the present invention, provided can be an image forming method and an image forming apparatus exhibiting neither failure in lack of line image nor image defect in halftone images, together with extremely high image quality and longer lifetime.

What is claimed is:

1. An image forming method comprising the steps of:

evenly charging an organic photoreceptor;

conducting a light exposure process to form an electrostatic latent image on the charged organic photoreceptor;

conducting a developing process to visualize the electrostatic latent image formed on the organic photoreceptor to form a toner image;

transferring the toner image onto a transfer medium; and conducting a cleaning process to remove a residual toner remaining on the organic photoreceptor from the organic photoreceptor, the image forming method further comprising the step of:

replenishing a developing device with a developer comprising a toner and a carrier having a lubricant present on a surface of the carrier, wherein the carrier comprises a magnetic core material, and a resin coating layer on the magnetic core material, the organic photoreceptor comprises a surface protective layer containing a filler, and the toner is mixed with the carrier having the lubricant onto a present on the surface of the carrier in advance.

2. The image forming method of claim 1, wherein the lubricant comprises a compound selected from the group consisting of a fatty acid metal salt, a fluorine-containing resin, a polyolefin resin and a paraffin wax.

3. The image forming method of claim 1, wherein the lubricant comprises a stearic acid metal salt.

4. The image forming method of claim 1, wherein the lubricant comprises zinc stearate.

5. The image forming method of claim 1, wherein the carrier particle has a volume average particle diameter of 20-40 μm.

6. The image forming method of claim 1, wherein the filler comprises an inorganic oxide particle.

7. The image forming method of claim 1, wherein the filler comprises at least one of a silica particle and an alumina particle.

8. An image forming apparatus comprising:

a charging device to evenly charge an organic photoreceptor;

a light exposure device to form an electrostatic latent image on the charged organic photoreceptor;

a developing device to visualize the electrostatic latent image formed on the organic photoreceptor to form a toner image;

a transfer device to transfer the toner image onto a transfer medium; and a cleaning device to remove a residual toner remaining on the organic photoreceptor from the organic photoreceptor, the image forming apparatus further comprising a replenishing device to replenish a developing device with a developer comprising a toner and a carrier having a lubricant present on a surface of the carrier, wherein the carrier comprises a magnetic core material, and a resin coating layer on the magnetic core material, the organic photoreceptor comprises a surface protective layer containing a filler, and the toner is mixed with the carrier having the lubricant on the surface of the carrier in advance.

9. The image forming apparatus of claim 8, wherein the lubricant is a compound selected from the group consisting of a fatty acid metal salt, a fluorine-containing resin, a polyolefin resin and a paraffin wax.

10. The image forming apparatus of claim 8, wherein the lubricant comprises a stearic acid metal salt.

11. The image forming apparatus of claim 8, wherein the lubricant comprises zinc stearate.

12. The image forming apparatus of claim 8, wherein the carrier particle has a volume average particle diameter of 20-40 μm.

13. The image forming apparatus of claim 8, wherein the filler comprises an inorganic oxide particle.

14. The image forming apparatus of claim 8, wherein the filler comprises at least one of a silica particle and an alumina particle.

* * * * *